United States Patent [19]

Jay

[11] Patent Number: 4,942,970

[45] Date of Patent: Jul. 24, 1990

[54] HERMETICALLY SEALED CANISTER

[75] Inventor: Murray Jay, Woodsburgh, N.Y., Vivian Jay, executrix

[73] Assignee: Vivian Jay, Woodsburgh, N.Y.

[21] Appl. No.: 218,972

[22] Filed: Jul. 14, 1988

[51] Int. Cl.[5] ..... B65D 45/00

[52] U.S. Cl. ..... 215/358; 215/262; 220/234

[58] Field of Search ..... 215/358, 359, 262, 296, 215/299; 220/233, 234, 358

[56] References Cited

U.S. PATENT DOCUMENTS 1,939,569 12/1933 Pfister ..... 215/359

4,537,325 8/1985 Zieff ..... 220/234

*Primary Examiner*—Stephen Marcus

*Attorney, Agent, or Firm*—Lilling & Greenspan

[57] ABSTRACT

The hermatic seal unit is for a container having a lower portion and an upper portion of a slightly greater diameter. There is a shoulder portion at the junction of the upper and lower end portions. The device includes a cover conforming in shape to the upper portion of the element. Spreader elements are pivotally positioned in the cover. The hermetic seal element is positioned on a lower portion of the cover and the spreaders are in contact with the inner surface of the hermetic seal element. The hermetic seal element is in intermittent contact with the top portion and shoulder of the container in order to intermittently define the hermetic seal.

1 Claim, 2 Drawing Sheets

FIG.1
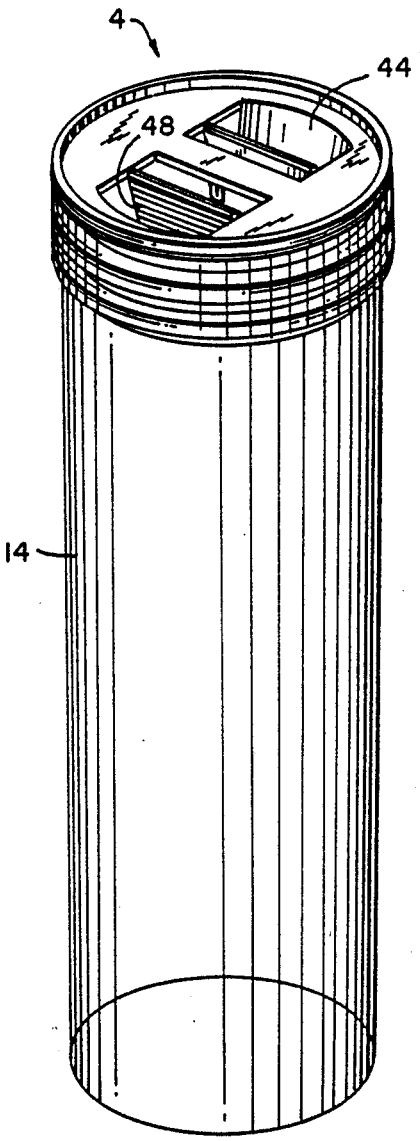
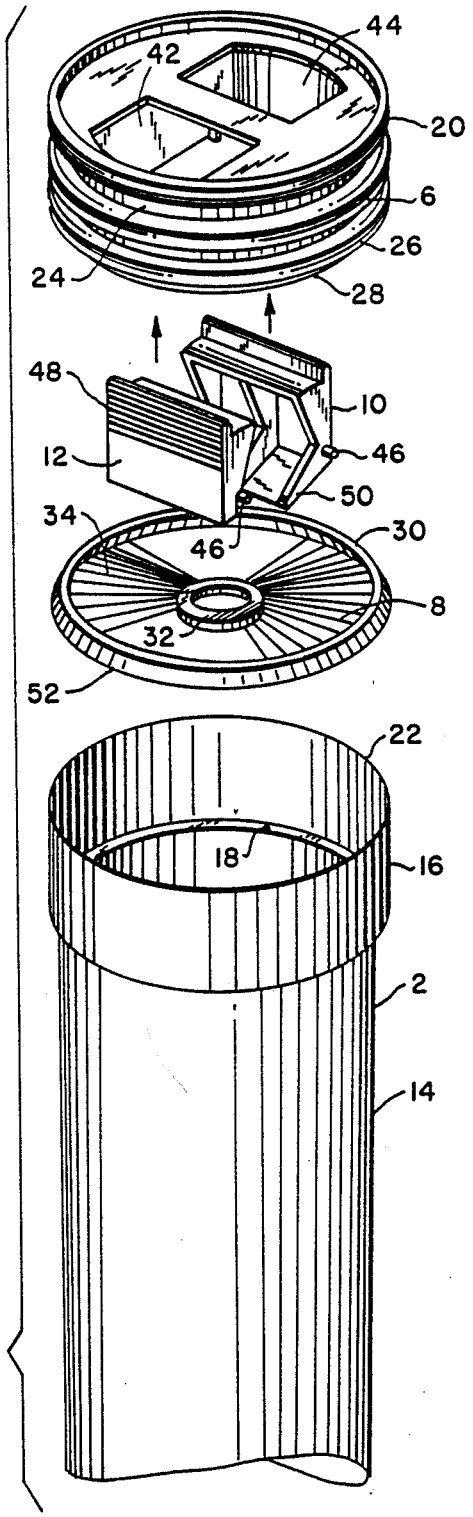
FIG.2

HERMETICALLY SEALED CANISTER

BACKGROUND OF THE INVENTION

One of the problems with canisters and bottles that are currently used for storing things, such as flour or sugar, is that there are no simple and efficient covers that can be used for hermetically sealing the container. It is important to be able to hermetically seal such containers in order to keep the food product fresh for long periods of time.

While there are covers that will hermetically seal such canisters and containers, these covers are complicated in structure and sometimes difficult to use. As a result, there is a need for a simple to make and use cover that can still hermetically seal a food container.

SUMMARY OF THE INVENTION

A closure unit is used to hermetically seal a food canister or container. According to the invention, the closure unit includes a cover with a thin sheet of plastic material frictionally held over its lower end. Two spreader pieces are made positioned in the cover. Grips for the spreaders extend through the top surface of the cover and can be squeezed together by the operator. This causes the spreaders to bear against the surface of the plastic material and to stretch it. As a result, the stretched plastic material moves away from the inner surface of the canister and breaks the hermetic seal and permits the easy removal of the closure unit. When the user releases the grips of the spreaders, the resilience of the plastic forces the spreaders back to the rest position and the plastic material is no longer stretched. This causes it to come back into engagement with the inner surface of the container and a hermetic sealed is obtained.

BRIEF DESCRIPTION OF THE DRAWINGS

FIG. 1 is a perspective view of the invention.

FIG. 2 is a vertical exploded view of the invention, showing the four major portions of the unit.

DETAILED DESCRIPTION OF THE INVENTION

Figure 3:
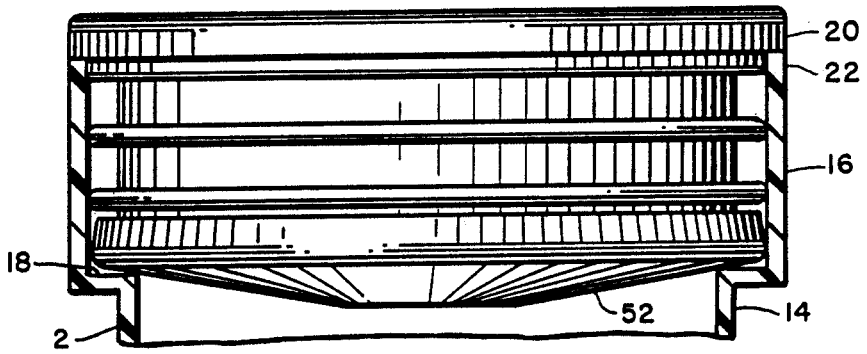
FIG. 3 is an enlarged sideview of the top portion of the canister with the closure unit.

The invention may be used for sealing any type of canister or container. The canister or container may be of any size or dimension, and it may be round or square or any other shape in its cross section. As shown in the drawings, the container 2 has a round cross section and is a long cylinder type canister. In the preferred embodiment, the container 2 is made from plastic, but it may also be made from glass or ceramic or any other suitable material.

The main or lower section 14 of the canister is made of the desired diameter or cross section. An upper portion 16 of the canister should be made of a slightly greater diameter or cross section in order to define a shoulder 18 at the junction of the lower and upper sections of the canister. As shown, the canister would be one continuous unit and the lower section 14, upper section 16 and the shoulder 18 would all be one integral unit.

The closure unit 4 includes three main pieces, i.e., the cover 6, the hermetic seal element 8 and the right and left spreaders 10 and 12. The cover 6 is of a shape that conforms to the cross section of the upper section 16 of the canister 2 and is round in the embodiment shown in the drawings. It is preferably made of a plastic material, but it can also be made of glass, ceramic or any suitable material. The top of the cover 6 includes a lip 20 which sits flush on the top edge 22 of the canister 2 in order to completely close the canister when the closure unit 4 is in position.

Along the outer surface 24 of the elongate portion of the cover 6 at least one ridge portion 26 is made. A slightly convex hermetic seal element 8 is placed over the bottom end 28 of the cover 6 and is frictionaly held by the ridge 26. In the preferred embodiment, the hermetic seal element 8 is a slightly convex plastic sheet, but it may be made of any strong and resilient material. The hermetic seal element 8 includes an up turned lip 30 which fits over and is held securely by the ridge 26. On the inner surface 34 of the hermetic seal element 8, a circular bearing surface 32 extends upward and toward the bottom end 28 of the cover 6.

The bottom end 28 of the cover 6 includes an inner support structure 38 which defines a cavity or space 44 between the inner support structure 38 and the outer surface 24 of the cover 6. The inner support structure 38 includes a central opening 40 in which the spreaders 10 and 12 are positioned. Two pairs of support eyes 36 are positioned on either side of the opening 40 on the inner support structure 38. Pegs 46 extending outward from the spreaders 10 and 12 snap fit into the support eyes 36 and permit the spreaders to rotate about an axis defined by the pegs 46 and the support eyes 36.

Figure 4:
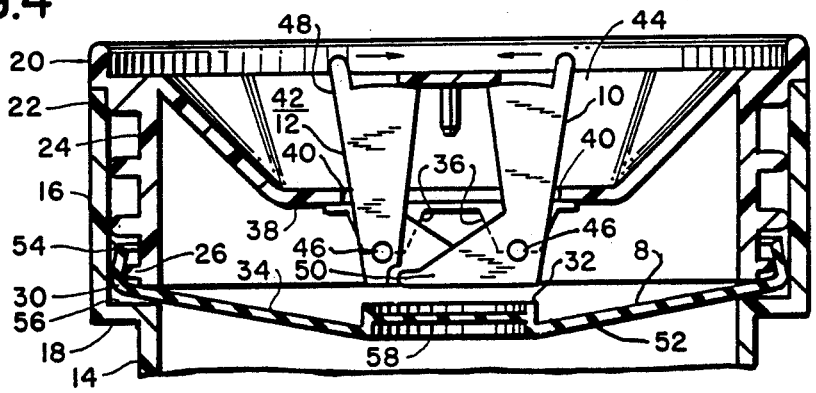
FIG. 4 is a cross section lower view showing the hermetic seal of the closure unit.
Figure 5:
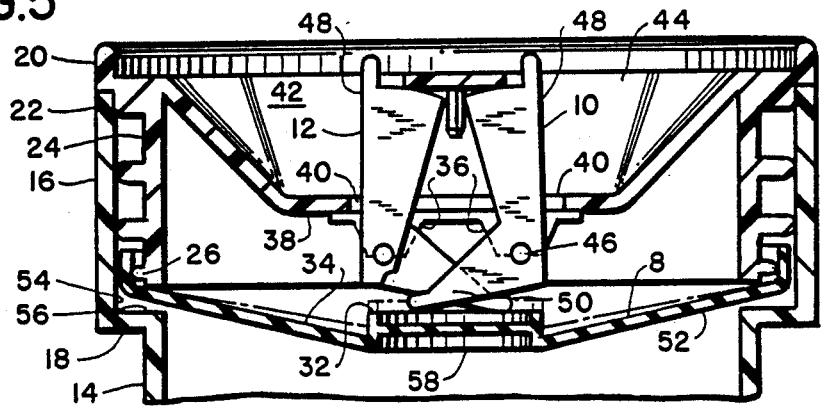
FIG. 5 is a view similar to FIG. 4, but it shows the closure unit when the hermetic seal has been broken and the closure unit is in position for removal from the canister.

The grip portions 48 of the spreaders 10 and 12 extend through the opening 40 in the cover 6 and are positioned in a grip opening 42 in the top portion of the cover 6. The opposite end of the spreaders 10 and 12 include engagement surfaces 50 which are in contact with the bearing surface 32 of the hermetic seal element 8. As best shown in FIGS. 4 and 5, the spreaders are preferably in a "L" shape with the vertical leg being composed by the grip 48 and the horizontal leg being defined by the engagement surface 50. In the normal rest position, the engagement surfaces 50 of the spreaders 10 and 12 are in a essentially horizontal position and are in contact with the bearing surface 32 of the hermetic seal element 8 (See FIG. 4). In this position, outer edge surface 52 of the seal element 8 is in contact with the inner surface 54 of the upper portion 16 of the canister and the top surface 56 of the shoulder 18, thus creating a hermetic seal and the canister or container is tightly closed, and the closure unit 4 cannot be easily removed.

In order to remove the closure unit 4, the user would place his or her fingers on the grip portion 48 of the spreaders 10 and 12 and push them together. This causes the spreaders 10 and 12 to pivot about the pegs 46 in the support eyes 36 and the engagement surfaces 50 of the spreaders cause the hermetic seal element 8 to be stretched and the center portion 58 of the hermetic seal element 8 is pushed downward (toward the interior portion of the canister)(FIG. 5). This stretching of the hermetic seal element 8 causes the outer edge surface 52 of the hermetic seal element to move away from the inner surface 54 of the top portion 16 of the canister and the top surface 56 of the shoulder 18 of the canister. This breaks the hermetic seal and permits the user to easily remove the closure unit 4.

To replace the closure unit 4, the user would again press the grips 48 together to stretch the hermetic seal element 8. In this manner, the closure unit can be easily inserted into the upper portion 16 of the canister. When the closure unit 4 is in position, the user would release the grips and the natural resilience of the hermetic seal element 8 would return the hermetic seal element 8 to its natural position (shown in FIG. 4) and cause the spreaders to return to their normal position. The engagement surfaces 50 would no longer be stretching the hermetic seal element and the outer edge surface 52 of the hermetic seal element 8 would again be in contact with the inner surface 54 of the upper portion 16 of the canister and the top surface 56 of the shoulder 18 of the canister and the hermetic seal would be regained.

I claim:

1. A hermetic seal unit for a container comprising a container having a lower portion, an upper portion of a slightly greater diameter than the lower portion, and a shoulder portion at the junction of the upper and lower portions;

a cover conforming in shape to the upper portion of said container;

spreader elements pivotaly positioned in said cover; and a hermetic seal element positioned on a lower portion of said cover and said spreaders being in contact with the inner surface of said hermetic seal element and said hermetic seal element being in intermittent contact with said top portion and shoulder of said container in order to intermittently define a hermetic seal.

* * * * *